US007752797B1

(12) United States Patent
Swan

(10) Patent No.: US 7,752,797 B1
(45) Date of Patent: Jul. 13, 2010

(54) SLING SWIVEL WITH INTEGRATED SCREWDRIVER

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 718 days.

(21) Appl. No.: 11/672,720

(22) Filed: Feb. 8, 2007

Related U.S. Application Data

(60) Provisional application No. 60/743,248, filed on Feb. 8, 2006.

(51) Int. Cl.
*F41C 23/00* (2006.01)

(52) U.S. Cl. ..... 42/85; 59/85

(58) Field of Classification Search ..... 42/85
See application file for complete search history.

(56) References Cited

U.S. PATENT DOCUMENTS

| | | | | | |
|---|---|---|---|---|---|
| 186,566 | A | | 1/1877 | Hotchkiss | |
| 985,190 | A | | 2/1911 | Mauser | |
| 2,078,010 | A | * | 4/1937 | Meepos | 42/85 |
| 2,078,591 | A | * | 4/1937 | Sprague | 42/85 |
| 2,190,268 | A | * | 2/1940 | Magid | 59/95 |
| 2,335,600 | A | * | 11/1943 | Mossberg | 42/75.01 |
| 2,758,440 | A | * | 8/1956 | Magid | 59/95 |
| 3,061,965 | A | * | 11/1962 | Lewis | 42/85 |
| 3,861,070 | A | * | 1/1975 | Wild et al. | 42/85 |
| 4,571,872 | A | * | 2/1986 | Johnson | 42/85 |
| 4,819,289 | A | | 4/1989 | Gibbs | |
| 4,823,491 | A | * | 4/1989 | Llames | 42/85 |
| 4,837,963 | A | | 6/1989 | Slappey, Jr. | |
| 4,845,871 | A | | 7/1989 | Swan | |
| 5,067,267 | A | * | 11/1991 | Ives | 42/85 |
| 5,075,996 | A | * | 12/1991 | Llames | 42/85 |
| 5,142,806 | A | | 9/1992 | Swan | |
| 5,261,136 | A | | 11/1993 | Hall | |
| 5,276,988 | A | | 1/1994 | Swan | |
| 5,343,650 | A | | 9/1994 | Swan | |
| 5,351,428 | A | | 10/1994 | Graham | |
| 5,417,003 | A | | 5/1995 | Claveau | |
| 5,533,292 | A | | 7/1996 | Swan | |
| 5,685,102 | A | * | 11/1997 | Latka | 42/85 |
| 5,692,654 | A | * | 12/1997 | Bell | 224/150 |
| 5,711,102 | A | * | 1/1998 | Plaster et al. | 42/71.01 |
| 5,848,491 | A | * | 12/1998 | Biemont | 42/85 |
| 6,230,430 | B1 | | 5/2001 | Gosselin | |
| 6,490,822 | B1 | | 12/2002 | Swan | |
| 6,520,390 | B2 | * | 2/2003 | Verdugo et al. | 224/150 |
| D472,166 | S | | 3/2003 | Swan | |
| 6,618,976 | B1 | | 9/2003 | Swan | |

(Continued)

*Primary Examiner*—Troy Chambers
*Assistant Examiner*—Samir Abdosh
(74) *Attorney, Agent, or Firm*—Barlow, Josephs & Holmes, Ltd.

(57) ABSTRACT

A sling swivel component that interfaces with an S.I.R. system to allow attachment of a sling strap thereto while also having a flat head screwdriver integrated into the end of the threaded neck of the swivel body itself is provided. The sling swivel includes a swivel body and a sling swivel pivotably attached to an upper end of the swivel body. The sling or shoulder strap passes through the elongated opening of the sling swivel. The swivel body includes a threaded neck that is sized for threaded engagement within one of the threaded openings that are normally provided along the S.I.R. system such as those found in one of the optional rail segments or directly in the lower hand guard of the rail system.

8 Claims, 5 Drawing Sheets

U.S. PATENT DOCUMENTS

| | | | | |
|---|---|---|---|---|
| D507,620 | S | 7/2005 | Swan | |
| D526,380 | S | 8/2006 | Swan | |
| D533,618 | S | 12/2006 | Swan | |
| RE39,465 | E | 1/2007 | Swan | |
| 7,562,481 | B2 * | 7/2009 | Esch | 42/85 |
| 2003/0046853 | A1 * | 3/2003 | Norris | 42/85 |
| 2005/0188594 | A1 * | 9/2005 | Tilby | 42/85 |
| 2006/0037226 | A1 * | 2/2006 | Garrett et al. | 42/85 |

* cited by examiner

SLING SWIVEL WITH INTEGRATED SCREWDRIVER

CROSS-REFERENCE TO RELATED APPLICATIONS

This application is related to and claims priority from earlier filed U.S. Provisional Patent Application No. 60/743,248, filed Feb. 8, 2006, the contents of which are incorporated herein by reference.

BACKGROUND OF THE INVENTION

The present invention relates generally to modular integrated rail assemblies for combat weapons. More specifically the present invention relates to a sling swivel that is removably securable to the modular rail assembly wherein the swivel includes an integrated flathead screwdriver for installation and removal of flathead fasteners and screws on the modular integrated rail assembly.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2 includes a lower receiver 4, upper receiver 6, butt stock 8, and barrel 10. (See FIG. 1)

The newer models of the M16/M4 weapons further include a mil-std 1913 dovetail rail 12 extending along the top of the upper receiver. This integrated receiver rail provides a convenient mounting point for many types of enhancement devices such as scopes and other sighting devices. However, space on the upper receiver rail is limited, and many military personnel often have multiple sighting devices that are each tailored to perform in different combat situations. In addition, there are a variety of lighting devices, handgrips, etc. that could also be attached to the weapon for enhanced use of the weapon. The difficulty is that there is simply not enough space on the integrated rail provided on the upper receiver to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel of the weapon that can support this important equipment and yet stand the test of rugged military use and abuse.

Responding to this need, the applicant has developed a modular integrated rail system (A.R.M.S.® S.I.R.® system), which has been well received by the military and has become popular with several branches of the military (See FIG. 2). The A.R.M.S. S.I.R. system is fully described in U.S. Pat. No. 6,490,822, the entire contents of which are incorporated herein by reference.

These modular integrated rail systems for combat weapons generally include an upper hand guard 14, a clamp 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 10.

The upper hand guard 14 is the main structural element of the system. The upper hand guard is 14 generally semi-cylindrical in shape and has a forward end and a rearward end and a mil-std 1913 dovetail rail extending longitudinally between the forward end and the rearward end. The semi-cylindrical upper hand guard 14 further includes symmetrically opposing side walls that extend outwardly and downwardly from the dovetail rail and terminate in symmetrically opposing longitudinally extending mounting channels. The mounting channels are used to mount various accessories, such as a lower hand guard or a grenade launcher, to the upper hand guard.

A clamp 16 is provided at the rearward end of the upper hand guard 14 to removably secure the upper hand guard 14 to the firearm 2. In the original S.I.R. system as shown in U.S. Pat. No. 6,490,822, the clamp is an elongated clamping rail that secures the upper hand guard to the dovetail rail on the top of the upper receiver of the weapon. In the newer S.I.R. systems, the clamp 16 is a U-shaped yoke that secures the upper hand guard 14 to the barrel nut as is depicted in FIG. 2. In both systems, a plurality of flathead slotted fasteners in the form of screws or locking pins extend through aligned openings in flanges of the upper hand guard and the clamp to draw the clamp and upper hand guard together.

There are also a plurality of other removable and non-removable flathead slotted fasteners that secure the lower hand guard to the upper hand guard, and that secure optional dovetail rail segments to the upper and lower hand guards.

As is well known in this area, field modification of weapons is critical in combat situations. For example, it may be desired to swap the lower hand guard for a grenade launcher, which can be attached to the upper hand guard, or to add an optional rail segment for securing an added accessory. The lower hand guard, as well as other accessories, can be easily removed by rotating the flat-head slotted fasteners. It is noted here that all of the slotted fasteners of the S.I.R. systems as described above use a common-sized flat head slotted fastener for securing all components. Field modification for this system requires only a slotted screwdriver, or if tools are not available, the slotted fasteners are conveniently sized to receive the edge of a US quarter. While in most cases, tools, such as a slotted screwdriver, are accessible to the soldier, it would be more advantageous to have the required tool travel with the rail system.

There is therefore a need for a tool that is incorporated into a component part of an S.I.R. system that is easily accessible for use in connection with removing or installing slotted flat head fasteners on the S.I.R. system. Further, there is a need for providing an accessible screwdriver in an integrated fashion with an S.I.R. system thereby facilitating the installation or removal of slotted fasteners thereby allowing for easy mounting, removal and interchangeability of component parts and accessories.

BRIEF SUMMARY OF THE INVENTION

In this regard, the present invention is directed to a sling swivel component that interfaces with the S.I.R. system to allow attachment of a sling strap thereto while also having a flat head screwdriver integrated into the end of the threaded neck of the swivel body itself. By creating a screwdriver on the end of the threaded neck of the sling swivel, a concealed and protected screwdriver is provided that is easily accessible when needed by field personnel in connection with the modification or servicing of their S.I.R. system and/or firearm.

The sling swivel includes a swivel body and a sling swivel pivotably attached to an upper end of the swivel body. The sling or shoulder strap passes through the elongated opening of the sling swivel portion as is well known. The swivel body includes a threaded neck that is sized for threaded engagement within one of the threaded openings that are normally provided along the S.I.R. system such as those found in one of the optional rail segments or directly in the lower hand guard of the rail system.

Located on the terminal end surface of the threaded neck is a rectangular raised shoulder that is configured and arranged for engagement with the slotted heads of any one of the flat head slotted fasteners. In other words, the raised shoulder is configured as the terminal end of a slotted screwdriver. Under normal use of the sling swivel, the threaded neck and the screwdriver on the end thereof is hidden within the threaded opening on the rail system. However, when the need arises, and conventional tools are not readily available, the soldier can unscrew the sling swivel from its threaded counterpart to reveal the hidden screwdriver. The raised shoulder is sized to fit snugly into the standardized slotted head portion of the fasteners on the S.I.R. system, while the elongated sling swivel portion provides a convenient handle for leverage in order to facilitate rotation of fasteners that may be tightly secured. The soldier thus has the comfort of knowing that he always has access to a back-up tool for field modification of his weapon, even when in a location of situation where tools may not be accessible.

It is therefore an object of the present invention to provide a tool that is integrated with a component of a S.I.R system that remains concealed during normal usage but is accessible when needed in connection with field modifications of the system. It is a further object of the present invention to provide a slotted screwdriver that is integrated into a component of an S.I.R. system wherein the screwdriver is particularly sized for installing or removing slotted fasteners used within the system. It is still a further object of the present invention to provide a slotted screwdriver that is integrated into a sling swivel mount such that in normal use the screwdriver is concealed yet the screwdriver remains accessible should it be required for field modification of the S.I.R. system.

These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
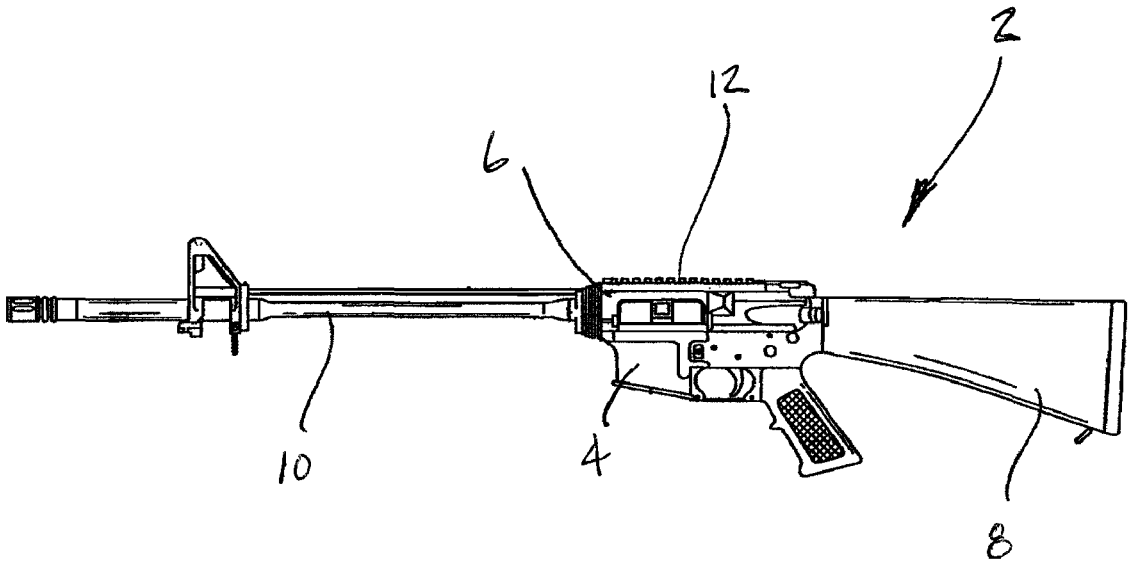
Fig. 1 (PRIOR ART)
FIG. 1 is a side view of a prior art firearm.
Figure 2:
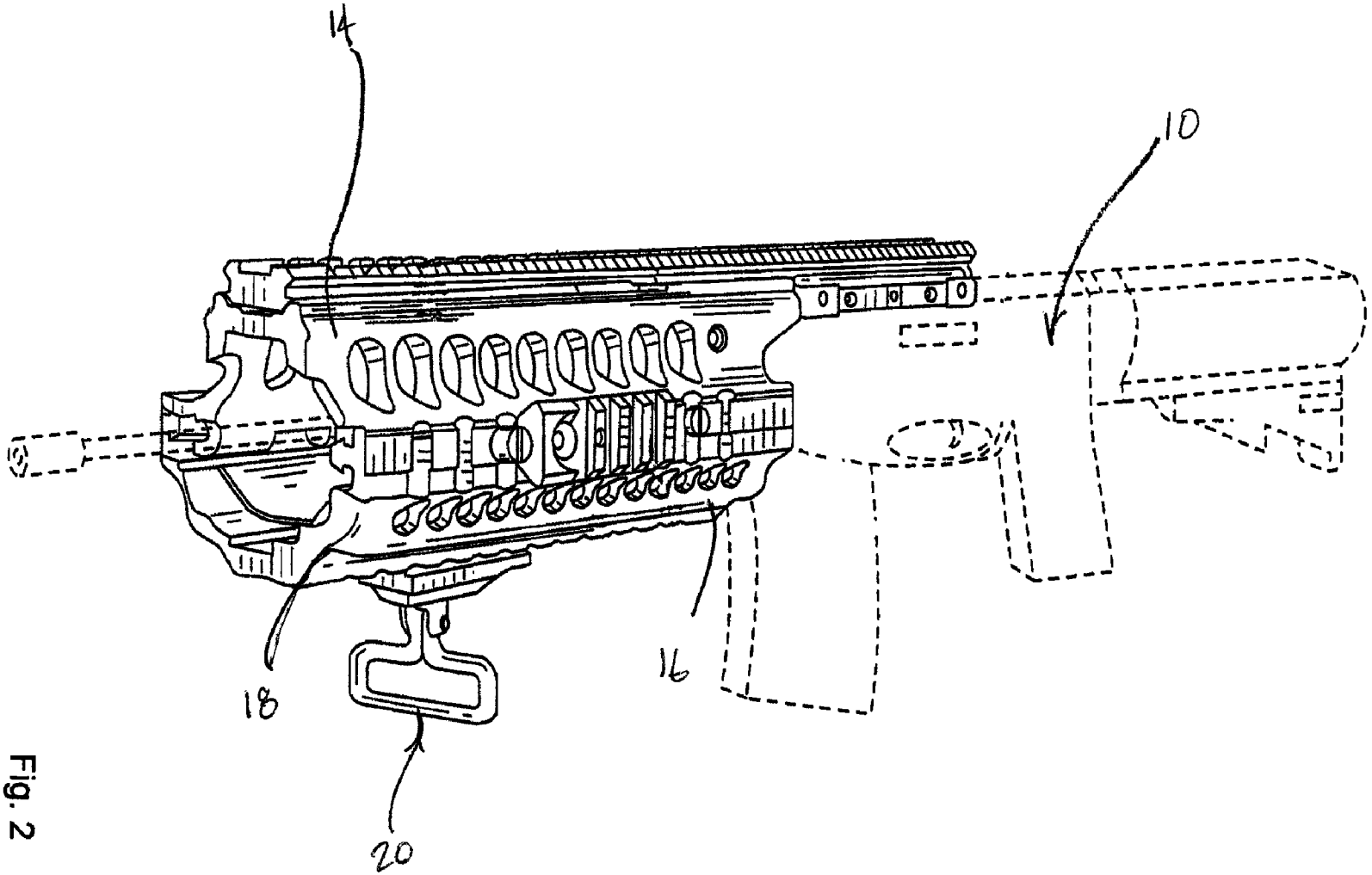
Fig. 2 (PRIOR ART)
FIG. 2 is a perspective view of a modular interface system.
Figure 3:
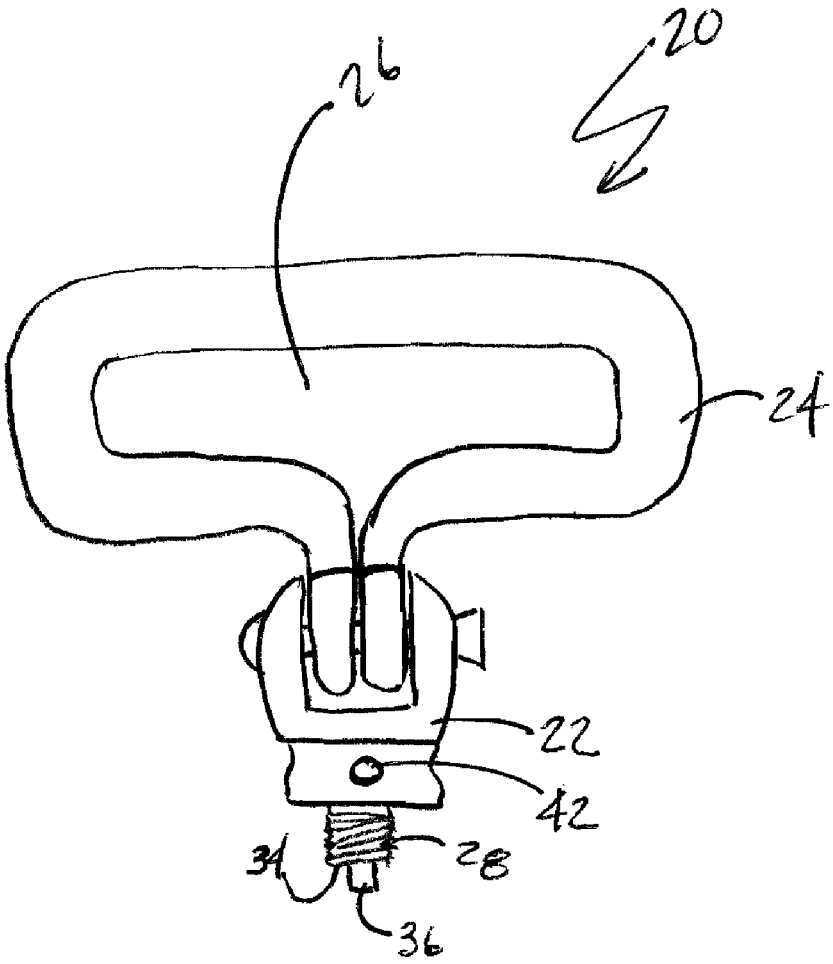
FIG. 3 is a side view of the integrated tool of the present invention.
Figure 4:
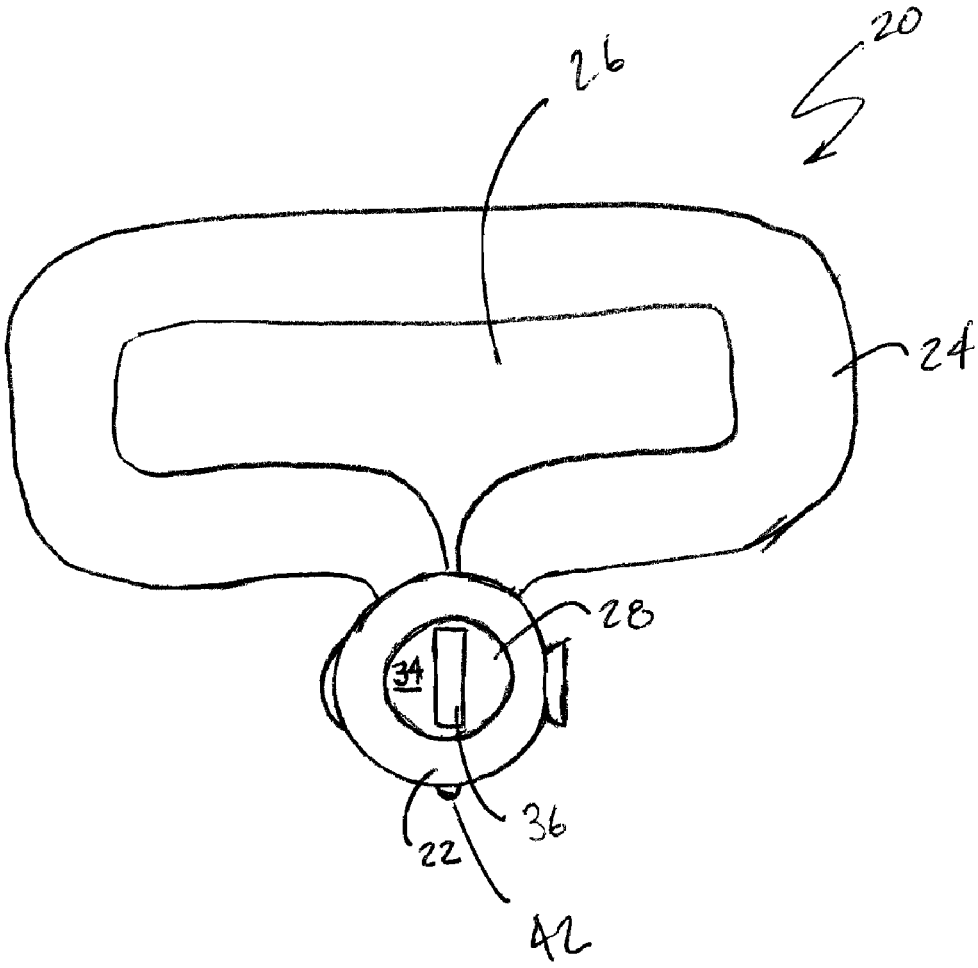
FIG. 4 is a bottom end view of the integrated tool of the present invention.
Figure 5:
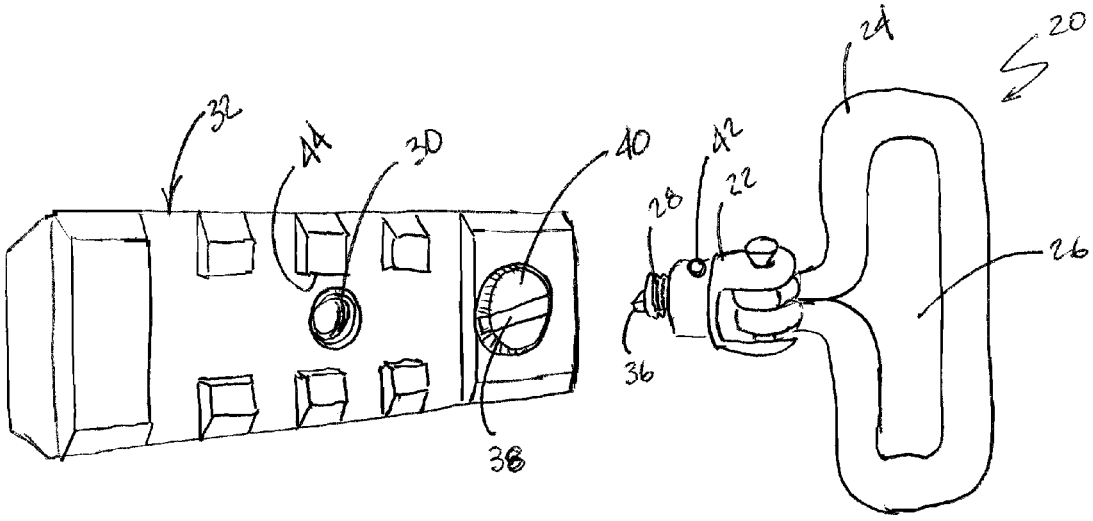
FIG. 5 is a perspective view of the integrated tool of the present invention in connection with an accessory rail mount.

Now referring to the drawings, the integrated tool component of the present invention system is shown and generally illustrated at FIGS. 3, 4 and 5. As can be seen, the present invention is directed to a sling swivel 20 having a flat head screwdriver integrated into the end of the threaded neck of the swivel body. Generally, the sling swivel 20 comprises a swivel body 22 and a strap loop 24 pivotably attached to an upper end of the swivel body 22. The shoulder strap (not shown) passes through an elongated opening 26 of the strap loop 24 as is well known in the art. The swivel body 22 includes a threaded neck 28, which is sized for threaded engagement with one of the threaded openings 30 typically found in one of the optional rail segments 32 or directly into a threaded opening 30 provided in the lower hand guard 18 of the rail system.

Located on the terminal end surface 34 of the threaded neck 28 is a rectangular raised shoulder 36 that is configured and arranged for engagement with the slot 38 provided within the head of any one of the flat head slotted fasteners 40 typically provided in the typical modular S.I.R. system. During normal use of the sling swivel 20, the raised shoulder 36 that functions as a screwdriver is hidden within the threaded opening 30 in the S.I.R system. However, when the need arises, and conventional tools are not readily available, the soldier can unscrew the sling swivel 20 from the threaded opening 30 in the accessory rail segment to reveal the hidden screwdriver in the form of the raised shoulder 36 on the terminal end surface 34 of the threaded neck 28. The raised shoulder 36 fits snugly into the slot 38 in the head portion of the fasteners 40, while the elongated strap loop 24 provides a convenient handle for leverage to rotate fasteners that may be tightly secured. The soldier thus has the comfort of knowing that he always has access to a back-up tool for modifying his weapon, even when out in the field where tools may not be accessible.

Another feature provided on the sling swivel of the present invention is the provision of a spring biased ball detent that prevents accidental loosening of the sling swivel 20 after it has been installed into the threaded opening 30 of the S.I.R. system. A ball detent is provided in the base of the swivel body. The ball detent 42 is spring biased so that it protrudes slightly beyond the outer surface of the swivel body 22 yet can be depressed into the swivel body 22 when sufficient force is exerted thereon. As can be seen in particular in FIG. 5, when the sling swivel 20 is fully threaded into the threaded opening 30 in the accessory rail section or the lower hand guard portion of the S.I.R. system, the ball detent 42 extends outwardly adjacent one of the raised shoulders 44 on the rail. In this manner, the sling swivel 20 cannot be unthreaded from the threaded opening 30 in the rail without intentionally exerting enough force to cause the ball detent 42 to retract into the swivel base 22 thereby allowing the swivel base 22 to rotate past the shoulder 44. Under normal usage, the forces exerted on the sling swivel 20 will not be sufficient to depress the ball detent 42 and therefore the ball detent 42 will prevent the sling swivel 20 from accidentally backing out of the threaded opening 30.

It can therefore be seen that the present invention provides a unique integrated tool that allows a soldier in the field the ability to modify or service their firearm and the S.I.R. system installed thereon even when in a location of situation that prevents access to traditional tools. Further, the present invention provides a unique and novel tool that fills a critical need for soldiers in the field. For these reasons, the present invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sling swivel for attaching a strap to an engaging structure comprising:

a swivel body having an upper portion and a lower portion, said lower portion having a threaded neck extending therefrom, said threaded neck having a terminal end surface, said terminal end surface having a raised rectangular shoulder extending outwardly therefrom, said raised rectangular shoulder comprising the terminal end of a slotted screwdriver and being configured and arranged for engagement with a slotted head of a slotted fastener; and a strap loop affixed to said upper portion of said swivel body.

2. The sling swivel of claim 1, wherein said strap loop is pivotally affixed to said upper portion of said swivel body.

3. The sling swivel of claim 1, wherein said engaging structure is a firearm.

4. The sling swivel of claim 1, wherein said engaging structure is an accessory mount system for a firearm.

5. The sling swivel of claim 1, wherein said engaging structure includes a threaded opening therein and a shoulder formation adjacent said threaded opening, said sling swivel further comprising:

a ball detent in a side wall of said swivel body, wherein said ball detent is spring biased outwardly and contacts said shoulder formation when said threaded neck is received in said threaded opening, said ball detent preventing accidental rotation of said sling swivel relative to said engaging structure.

6. A modular firearm accessory system comprising in combination:

an accessory mount including at least one threaded opening; and a sling swivel for attaching a strap to said accessory mount, said sling swivel comprising:

a swivel body having an upper portion and a lower portion, said lower portion having a threaded neck extending therefrom, said threaded neck having a terminal end surface, said terminal end surface having a raised rectangular shoulder extending outwardly therefrom said raised rectangular shoulder comprising the terminal end of a slotted screwdriver and being configured and arranged for engagement with a slotted head of a slotted fastener; and a strap loop affixed to said upper portion of said swivel body.

7. The modular firearm accessory system of claim 6, wherein said strap loop is pivotally affixed to said upper portion of said swivel body.

8. The modular firearm accessory system of claim 6, wherein said accessory mount includes a shoulder formation adjacent said threaded opening, said sling swivel further comprising:

a ball detent in a side wall of said swivel body, wherein said ball detent is spring biased outwardly and contacts said shoulder formation when said threaded neck is received in said threaded opening, said ball detent preventing accidental rotation of said sling swivel relative to said accessory mount.

* * * * *